US005778944A

United States Patent [19]

Hagens

[11] Patent Number: 5,778,944

[45] Date of Patent: Jul. 14, 1998

[54] APPARATUS FOR APPLYING TIEING DEVICES TO CROSSING REINFORCEMENT RODS FOR CONNECTING THE SAME

[75] Inventor: Peter Hagens, Støvring, Denmark

[73] Assignee: Hagens Fiedre K/S, Stovring, Denmark

[21] Appl. No.: 671,843

[22] Filed: Jun. 28, 1996

Related U.S. Application Data

[62] Division of Ser. No. 29,595, Mar. 11, 1993, Pat. No. 5,542, 228.

[30] Foreign Application Priority Data

Mar. 11, 1992 [DK] Denmark ..... 0326/92
Sep. 14, 1992 [DK] Denmark ..... 1128/92

[51] Int. Cl.[6] ..... B21F 33/00

[52] U.S. Cl. ..... 140/53; 29/809; 29/811.2; 140/57

[58] Field of Search ..... 29/809, 811.2, 29/816; 140/118, 113, 115, 119, 149, 53, 54, 57, 93.6, 93 A

[56] References Cited

U.S. PATENT DOCUMENTS 3,494,385 2/1970 Hanigan ..... 140/93.6
5,178,195 1/1993 Glaus et al. ..... 29/809 X

FOREIGN PATENT DOCUMENTS 1-244076 9/1989 Japan ..... 140/93.6
453607 2/1988 Sweden .
82/02867 9/1982 WIPO ..... 140/93 A

*Primary Examiner*—S. Thomas Hughes
*Attorney, Agent, or Firm*—Antonelli, Terry, Stout & Kraus, LLP

[57] ABSTRACT

A tieing device in the form of a wire element preferably made of spring steel consists of a straight piece of wire with an elbow and two hooks facing in opposite directions. The wire element is simple and inexpensive to manufacture and furthermore simple to apply. An apparatus for fitting the wire elements uses a particular oblique placement of a wire element magazine and two plungers, one of which displaces the wire element sideways and the other subsequently pushes one hook under one of the reinforcing rods.

7 Claims, 4 Drawing Sheets

APPARATUS FOR APPLYING TIEING DEVICES TO CROSSING REINFORCEMENT RODS FOR CONNECTING THE SAME

This application is a Division of application Ser. No. 08/029,595, filed Mar. 11, 1993 and now U.S. Pat. No. 5,542,228.

BACKGROUND OF THE INVENTION

1. Field of the Invention

The present invention is generally related to a tieing device made of wire for connecting reinforcing rods for concrete constructions as well as apparatus for use in applying such devices.

2. Description of the Prior Art

From SE-FS 453 607 such a device is known for tieing reinforcing rods, but it is fairly complicated to manufacture and in consequence expensive.

From U.S. Pat. No. 1,263,887 a wire clip is known, the ends of which grips one reinforcing rod and the middle part grips the crossing reinforcing rod. The wire is bent into a quite complex shape, but the retaining ability of this wire clip is not sufficient, because of the need for a fairly large distance between the points of attack of this clip.

From DE-B 919 606 a spring clip of simple shape is known which according to one embodiment consists of a straight piece joining two hooks. The patent states that the shape of the hook parts is unimportant, and the retaining ability of this spring clip is entirely dependent on the stiffness of the straight piece. Also the fitting of the spring clip is difficult because the straight piece has a tendency to turn during application.

OBJECTS OF THE INVENTION

Accordingly, it is an object of the invention to provide a unique tieing device which displays none of the disadvantages mentioned above and which is simple to apply and which has great strength in holding reinforcing rods together.

It is another object of the invention to provide a grid consisting of intersecting reinforcing rods fitted with tieing devices of the type specified herein.

BRIEF DESCRIPTION OF THE DRAWINGS

FIGS. 9, 12, 13, and 14 are side views, while

According to the invention it has been realized that an improved result may be obtained with a simple device made of one piece of wire. Known devices have not made use of positive friction between the clips and the reinforcing rods. The wire element according to the invention is particular in that it consists of a piece of wire with the ends bent into hooks on either side thereof and by providing the wire element with an elbow midway between the ends. This has the advantage that the wire element becomes self-centering whereby fitting becomes easier.

In a preferred embodiment the very ends of the wire are straight pieces continuing the circular hooks into tangents including an angle between the central part and the tangent. If the outer ends of the bends are not made long enough they may lose the grip around the reinforcing rod during handling of the reinforcement or the subsequent pouring of the concrete and the vibration.

An improved grip may be obtained in further preferred embodiment by letting the relaxed radius of curvature of the hook be slightly smaller than half the diameter of the reinforcing rod it has to grip.

In a further preferred embodiment the hooks are shaped to take an elliptical shape when gripping the reinforcing rod. This elliptical shape is derived from the elliptical section of a plane cutting a cylinder at an oblique angle.

The element is preferably made of spring steel but may also be made of a suitable plastic material. Technically the element is simple to manufacture because it may be made in one operation, and consequently it is also inexpensive.

The wire element is fitted by threading one bend about a reinforcing rod and over the crossing reinforcing rod which is to be secured and by pushing the other bend about the first reinforcing rod.

An apparatus according to the invention for use in fitting the wire element carrying a magazine for holding a number of such wire elements is particular in that the magazine is disposed at an angle and is turned around its longitudinal axis in order that the wire element which is prepared for fitting has one end disposed in a level below the lower reinforcing rod, and in that the wire element is disposed across the rods, so that the other end of the wire element is disposed in a level above the lower reinforcing rod, and in that it comprises a first plunger for sideways movement of the wire element out of the magazine and with the lower end of the wire element below the reinforcing rod, and the upper end above and to the side of the rod, whereby a second plunger controlled by a roller in guideways provides a push on the upper end of the wire element below the lower reinforcing rod.

DETAILED DESCRIPTION OF THE PREFERRED EMBODIMENT

Figure 1:
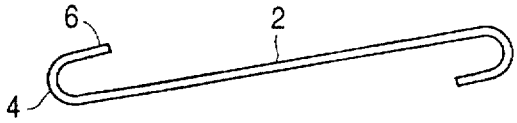
FIG. 1 shows a wire element according to a first embodiment of the invention.

Referring to FIG. 1, there is shown a first embodiment of the invention, which is a wire element made of spring steel. The wire element comprises a straight central piece 2 which at the ends changes into hook-shaped bends 4 which are disposed in the same plane as the body. The hooks are semi-circular and end with a straight piece 6 which is disposed at an angle to the central piece.

Figure 2:
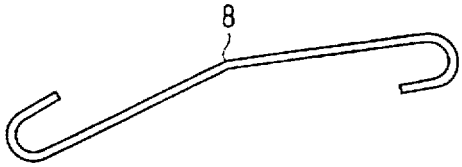
FIG. 2 shows a wire element according to another embodiment of the invention.
Figure 3:
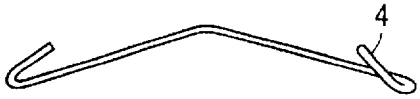
FIG. 3 shows a wire element according to a third embodiment of the invention.

A slightly different embodiment is shown in FIG. 2 which is distinguished from the embodiment shown in FIG. 1 by an elbow 8 at the mid-point of the central piece 2. Thereby the two parts of the central piece and the hooks lie in planes which intersect on a line through the point 8. In this manner the application of the wire element is facilitated.

The hooks have to have a certain minimum length in order not to lose the grip during the further handling of the reinforcement and pouring and vibration of the concrete. By bending the hooks 4 out of the plane comprising the central piece they will obtain a larger contact area with the reinforcing rod.

Figure 4:
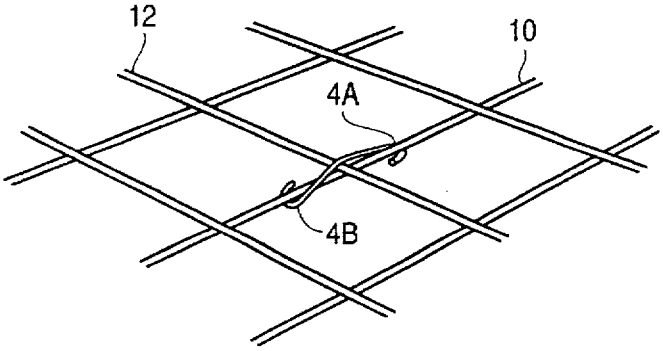
FIG. 4 shows a section of a grid of reinforcing rods with a node connected by means of a wire element as shown in FIG. 2.

In FIG. 4 is shown a section of a reinforcing grid which two reinforcing rods 10 and 12 being tied with a wire element as shown in FIG. 2. One end 4A of the wire element is threaded around the reinforcing rod 10, so that it crosses the other reinforcing rod 12. By pressing down on the other end 4B of the wire element it will center itself with the elbow situated on the crossing reinforcing rod 12. The end 4B is brought down adjacent to the reinforcing rod 10 and is displaced sideways below it in order that the hook springs up around the rod 10 when it is released. The fitting is quite simple to perform.

Figure 5:
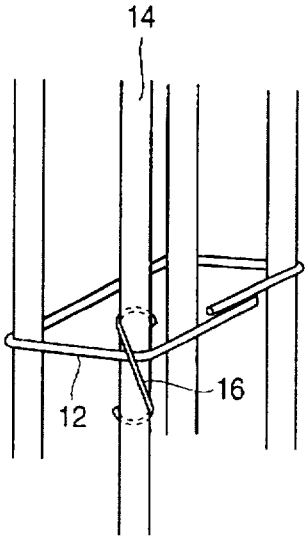
FIG. 5 shows a section of a pillar reinforcement where a reinforcing bracket is secured by means of a wire element as shown in FIG. 2.

The wire element can also be used for tieing a pillar reinforcement as shown in FIG. 5, where a reinforcing bracket 12 is fixed to a reinforcing rod 14 by means of a wire element 16 of the type shown in FIG. 2.

Figure 6:
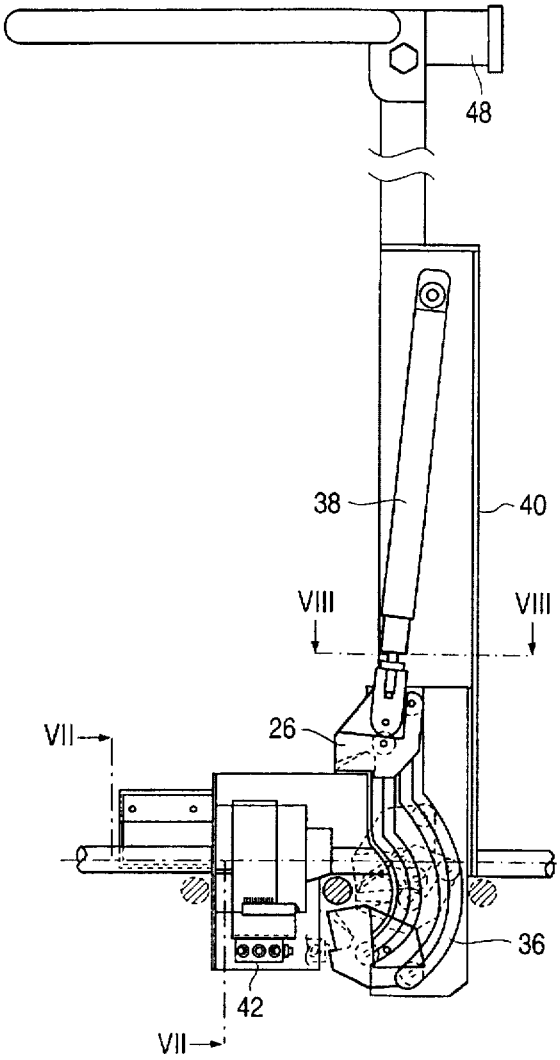
FIG. 6 shows an apparatus for applying the wire elements, without magazine and cover, section VI—VI of FIG. 8.
Figure 8:
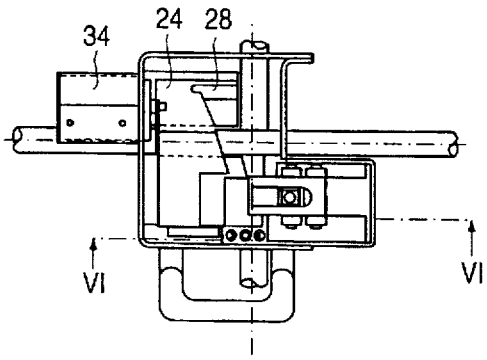
FIG. 8 shows a section of the apparatus, section VIII—VIII of FIG. 6, FIG. 9–14 show a wire element during the application to two perpendicularly crossing reinforcing rods, where
Figure 7:
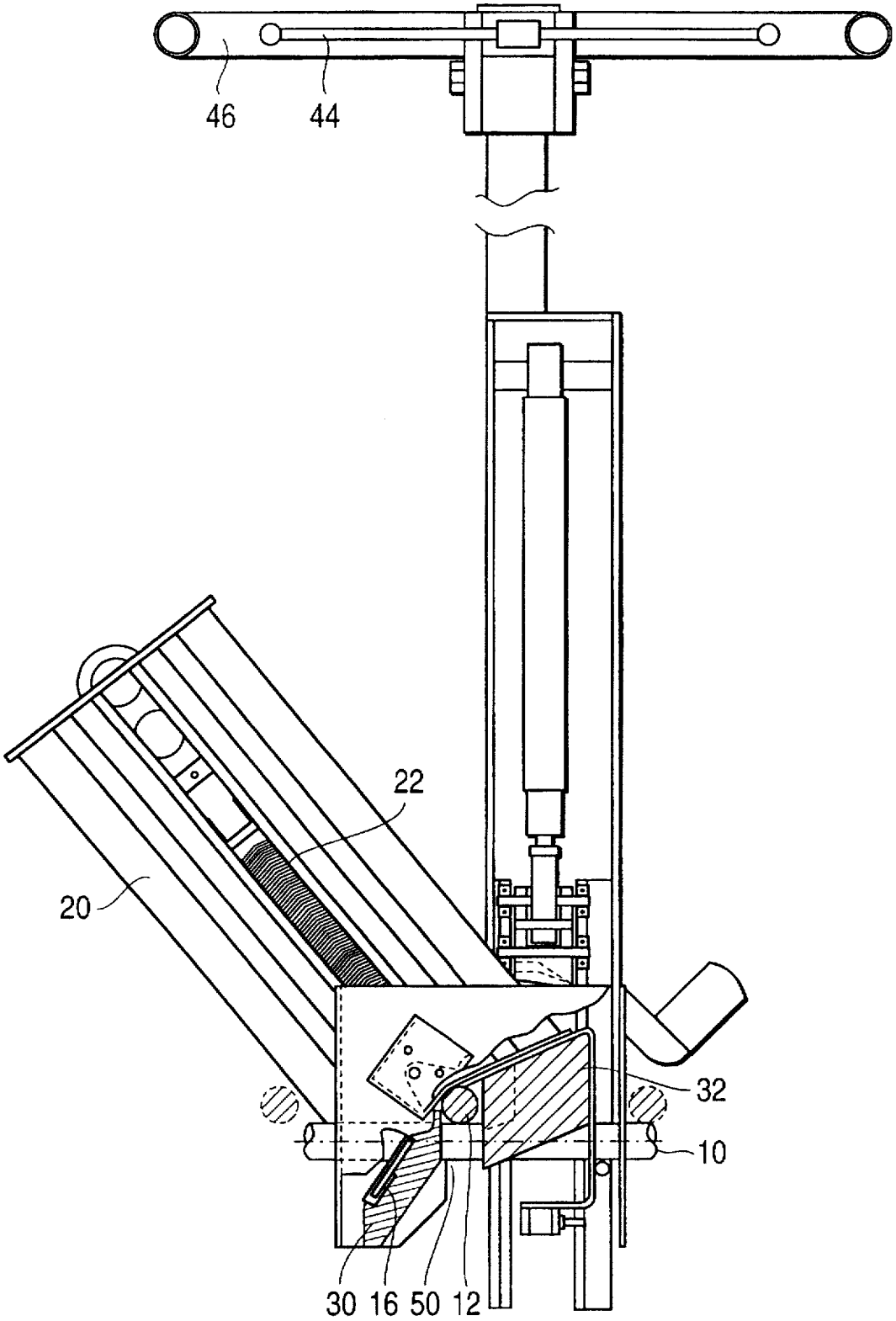
FIG. 7 shows the apparatus seen from behind, with magazine fitted, section VII—VII of FIG. 6.

An apparatus for fitting the embodiment of the wire element shown in FIG. 2 is shown schematically in FIGS. 6–8. The apparatus is based on the wire elements being supplied in "clips" of a specific length, i.e. the wire elements are connected to each other in a long row in a known manner, e.g. by means of a varnish or glue. The apparatus comprises a magazine 20 for such "clips" of binders. In FIG. 7 the magazine is shown loaded with such a "clip" 22 of binders which is loaded into the magazine from one end and which is urged forward by a spring as is well known in this type of magazine.

Figure 9:
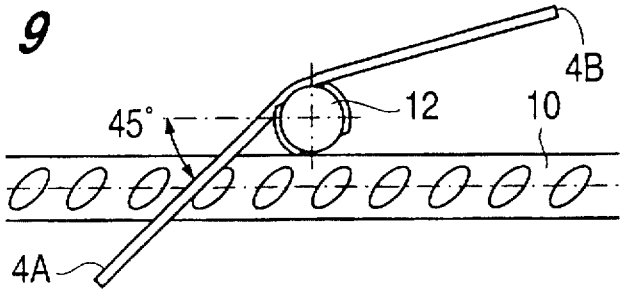
Figure 10:
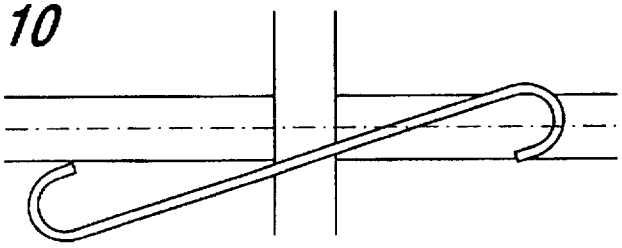
FIGS. 10 and 11 are top views.

The wire elements are fitted by a combination of the position of the magazine with respect to the placement of the apparatus on the reinforcement and two plungers 24, 26. Apart from having an oblique position as shown in FIG. 7 the magazine 20 is turned whereby the wire elements receive the starting position shown in FIGS. 9 and 10, where the wire element in FIG. 9 is seen from the side and in FIG. 10 from above. The wire element is disposed obliquely corresponding to the position of the magazine so that one end 4A with the hook is at a level below the lowermost reinforcing rod 10, and the other end 4B is at a level which is above the topmost reinforcing rod 12. The wire element is as yet quite unstressed. The bottom end 4A of the wire element is furthermore displaced sideways with respect to the bottom reinforcing rod 10. The rotation of the magazine about its longitudinal axis is adjusted in order that upper end 4B of the wire element is disposed more or less directly above the rod 10. This corresponds to the slanted end 28 of the plunger 24.

The wire elements are expelled through the mouth of the magazine against two slide plates 30 and 32 shown in FIG. 7 which act as positioning means, where a wire element 16 is shown in place in a preparatory position against the slide plates 30 and 32. The wire element is furthermore supported by the edge 28 of the plunger 25. The plunger 24 may be brought forward by means of a pneumatic cylinder B4 whereby the wire element 16 is broken loose from the "clip" 22 and sideways displaced to the position shown in FIG. 9 but where the bottom end 4A is pushed under the lower reinforcing rod 10, while the upper end 4B is pushed sideways. The wire element itself is still not stressed mechanically, and the angular position is the same as before. Thus, the plunger 24 and pneumatic cylinder 34 serve as first plunger means for displacing the exposed tieing spring wire member from the preparatory position into a position in which the end 4A is located outside of the rod 10 without lateral spacing therefrom and in which end 4B is located at the proximate side of the rod 12 laterally spaced therefrom.

Figure 11:
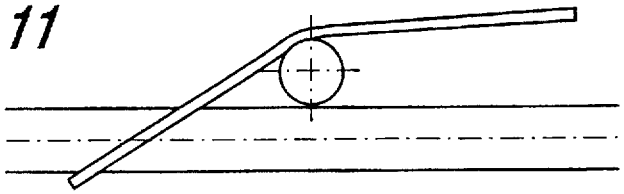
Figure 12:
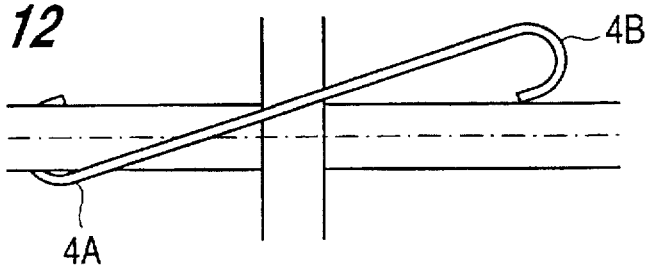
Figure 13:
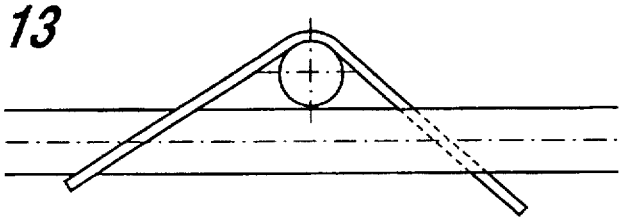
Figure 14:
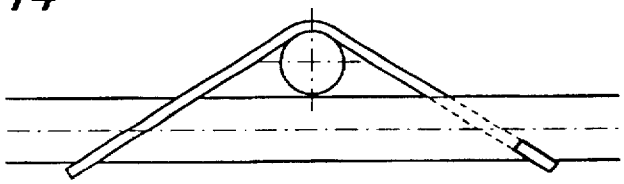

The movement of the second plunger 26 is controlled by means of rollers in guideways 36 on both sides. The plunger 26 is moved by means of a pneumatic cylinder 38 in the handle 40 of the apparatus. Thus, the pneumatic cylinder 38 and plunger 26 form second plunger means for forcing the end 4B. More specifically, in FIG. 6 the plunger is shown in its starting position in broken lines where the upper end 4B of the wire element is pushed under the plunger corresponding to the position shown in FIG. 11. By activating the pneumatic cylinder the plunger 26 will press against the upper end 4B which initially will cause the wire element to pivot on the upper reinforcing rod 12 so that the bottom hook 4A grips the lower reinforcing rod 10 as shown in FIGS. 11 and 12. In its further movement the plunger 26 will start a rotation caused by the guideway and push the end 4B of the wire element below the reinforcing rod 10 to the position shown in FIG. 13. At maximum extent of the travel of the plunger 26 the end 4B will spring upwards to engage the reinforcing rod 10. The two reinforcing rods 10 and 12 are thus linked at their point of intersection.

In its final position a protruding end of the plunger 26 actives a pneumatic valve 42 mounted on the other plunger which causes the plungers to reverse to their starting position. In FIG. 6 the valve 42 is shown in its forward position in broken lines, with the plunger 26 at its maximum extent shown in unbroken lines.

The apparatus is controlled by an activating lever 44, shown in FIG. 7. At the end of the handle 40 there is a frame 46, and a pneumatic valve 48 controlled by the lever 44 may be reached from the frame.

The bottom end of the apparatus has two slots 50 at right angles to each other in order that the apparatus may be placed over intersecting reinforcing rods 10, 12. The entry to the slots define an angular space, V-shaped as shown in FIG. 7, between them in order that the apparatus will find the correct position while engaging the reinforcing rods.

The apparatus described above is simple to use and durable, and it ensures a secure fitting of the wire elements.

Even quite small improvements and savings have a large influence, because a large number of ties have to be made even in fairly simple constructions of reinforced concrete, and in the case of e.g. large bridge constructions the influence on cost is dramatic.

To illustrate the need for improvement it should be mentioned that although a number of spring clips of similar types are known, tieing with simple iron wire is still widely performed because the known spring clips are relatively expensive and difficult to fit. These problems have been solved by the present invention.

What I claim is:

1. An apparatus for mounting tieing spring wire members over crossings of intercrossing reinforcing rods in a common rod plane to connect said reinforcing rods together, said tieing spring wire members being shaped as a piece of wire having an intermediate portion and respective, opposed first and second hook shaped end portions bent laterally outwardly from said intermediate portion to respective opposite sides thereof, said apparatus comprising:

a magazine for holding a row of said tieing spring wire members so as to expose a tieing member thereof to a rod crossing having first and second rods crossing one another in a common rod plane, at which the apparatus is placed from one side of said common rod plane for cooperation with said first rod which is close to the apparatus and said second rod crossing the first rod at the opposite side thereof, said rods having proximate sides facing the apparatus and distal sides facing away therefrom;

a rod engaging base portion for engaging said intercrossing rods to define an apparatus position in which said exposed tieing spring wire member assumes a position with said intermediate portion thereof crossing over said first rod and with said opposed hook shaped ends located in the vicinity of said second rod;

positioning means for positioning said exposed tieing spring wire member in a preparatory position in which a first of said hook shaped ends is located laterally outside the distal side of said second rod and the second hook shaped end is located at the proximate side of this rod when said apparatus is located in said apparatus position;

first plunger means for displacing said exposed tieing spring wire member from said preparatory position into a position in which said first hook shaped end is located outside the distal side of the rod without lateral spacing therefrom and in which the second hook shaped end is located at the proximate side of the second rod laterally spaced therefrom; and second plunger means for forcing the second hook shaped end from the proximate to the distal side of the second rod into a release position from which the second hook shaped end snaps into holding engagement with said distal side for connecting said intercrossing reinforcing rods together.

2. An apparatus according to claim 1, in which said positioning means comprise a fixed part of the apparatus operable to position said exposed tieing spring wire member in said preparatory position when said rod engaging base portion is engaged with said intercrossing rods in said apparatus position.

3. An apparatus according to claim 2, in which said fixed part comprises two slide plates in a mouth area of said magazine facing the rod crossing, the magazine assuming an oblique position when said apparatus is in said apparatus position so as to present said exposed spring wire member against said two slide plates with an orientation of said exposed spring wire member in said preparatory position thereof.

4. An apparatus according to claim 3, in which said magazine mouth area is inverted V-shaped for cooperating with tieing spring wire members preshaped with an elbow midways on said intermediate wire portion.

5. An apparatus according to claim 1, in which said first plunger means comprises a first plunger operable to push said exposed tieing spring wire member laterally away from a mouth area of the magazine.

6. An apparatus according to claim 5, including actuator means for actuating first said first plunger means and then said second plunger means and thereafter effecting retraction of both upon completion of the operation of said second plunger means.

7. An apparatus according to claim 1, wherein said rod engaging base portion comprises an operating end fitted with two crossing slots with V-shaped guides at entries thereof for placing on the intersection between said first and second rods to that said apparatus is in said apparatus position.

* * * * *